US009592593B2

(12) United States Patent
Chen et al.

(10) Patent No.: US 9,592,593 B2
(45) Date of Patent: Mar. 14, 2017

(54) TORSION-ADJUSTABLE IMPACT WRENCH

(71) Applicant: Chervon (HK) Limited, Wanchai (HK)

(72) Inventors: Liang Chen, Nanjing (CN); Wu Chen, Nanjing (CN); Jianwen Yang, Nanjing (CN); Qiwei Zhou, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 691 days.

(21) Appl. No.: 13/782,393

(22) Filed: Mar. 1, 2013

(65) Prior Publication Data

US 2013/0228353 A1 Sep. 5, 2013

(30) Foreign Application Priority Data

Mar. 2, 2012 (CN) ..... 2012 1 0052694

(51) Int. Cl.
*B25B 21/00* (2006.01)
*B25B 23/147* (2006.01)

(52) U.S. Cl.
CPC ..... *B25B 21/008* (2013.01); *B25B 23/1475* (2013.01)

(58) Field of Classification Search
CPC ..... B25B 23/1453
See application file for complete search history.

(56) References Cited

U.S. PATENT DOCUMENTS 5,154,242 A * 10/1992 Soshin et al. ..... 173/178
5,737,483 A * 4/1998 Inaji ..... G11B 15/46 318/609
7,064,462 B2 * 6/2006 Hempe ..... B23D 45/16 173/217
7,080,578 B2 * 7/2006 Izumisawa ..... B25B 21/004 173/168
7,334,648 B2 * 2/2008 Arimura ..... B25B 21/02 173/176
2005/0109519 A1 * 5/2005 Kawai ..... B25B 23/1405 173/183
2005/0217875 A1 * 10/2005 Forster ..... B25C 1/06 173/1
2005/0263305 A1 * 12/2005 Shimizu et al. ..... 173/2
2008/0271904 A1 * 11/2008 Lin ..... 173/20
(Continued)

FOREIGN PATENT DOCUMENTS

WO WO 2012023452 A1 * 2/2012

*Primary Examiner* — Hemant M Desai
*Assistant Examiner* — Tanzim Imam
(74) *Attorney, Agent, or Firm* — Greenberg Traurig, LLP

(57) ABSTRACT

A torsion-adjustable impact wrench, includes a housing, a powering unit including an impact mechanism configured to generate an intermittently increasing torque, an adjusting unit configured to manually set a first torsion value and generate a corresponding first torsion signal, a detecting unit configured to detect a rotational speed of the powering unit and generate a corresponding first rotational speed signal, and a control unit configured to generate a control signal for controlling the output of the rotational speed of the powering unit. The control unit generates a second rotational speed signal according to the first torsion signal outputted by the adjusting unit, compares the first rotational speed signal with the second rotational speed signal, and generates a control signal enabling the rotational speed of the powering unit to approach the second rotational speed.

11 Claims, 4 Drawing Sheets

(56) References Cited

U.S. PATENT DOCUMENTS

| | | | | |
|---|---|---|---|---|
| 2011/0088921 | A1* | 4/2011 | Forgues et al. | 173/1 |
| 2011/0186318 | A1* | 8/2011 | Ichikawa | H02P 6/06 173/176 |
| 2012/0169256 | A1* | 7/2012 | Suda | B25B 21/00 318/17 |

* cited by examiner

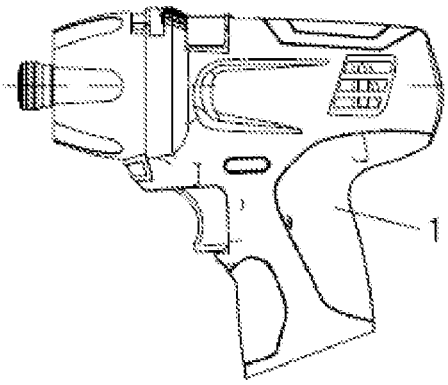
FIG.1-A
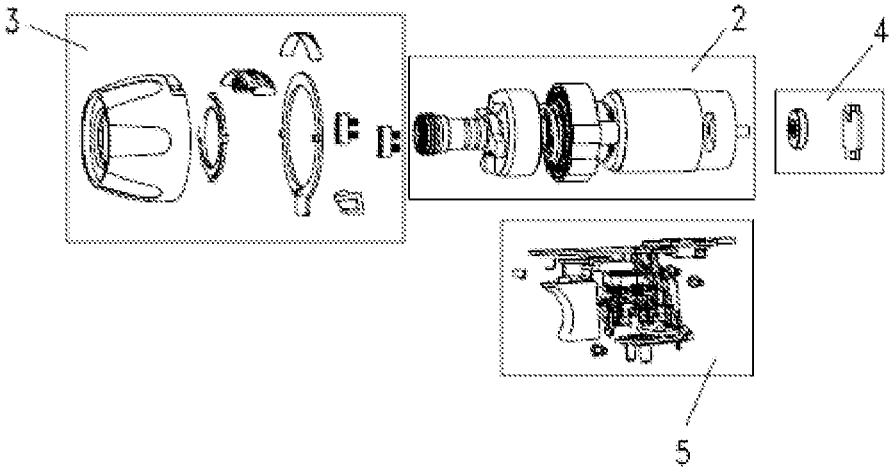
FIG.1-B
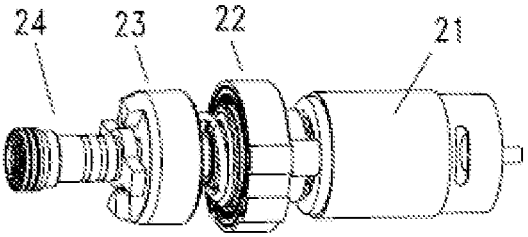
FIG.2

TORSION-ADJUSTABLE IMPACT WRENCH

RELATED APPLICATION

This application claims the benefit of CN 201210052694.4, filed on Mar. 2, 2012, the disclosure of which is incorporated herein by reference in its entirety.

BACKGROUND

The following generally relates to hand-held power tools and, more particularly, to a torsion-adjustable impact wrench.

In the past, an operator generally used a wrench to manually fasten a fastener, such as a bolt or nut, and judged whether the fastener reached a fastened degree by means of hand inspection upon the fastening. At present, a power impact wrench is increasingly used in fastening operations. However, it is difficult to judge whether a fastener is already in a fastened state when a power impact wrench is used in a fastening operation. Currently, the operator generally judges whether the fastener is fastened by his own pre judgment or in a way that the tool operates in a stalled state. However, this may cause damages to a workpiece and may affect the service life of the power tool. Furthermore, because output torsion of the power impact wrench is unadjustable or an adjustment precision is relatively low, it is difficult for the operator to obtain a desired fastening torsion during a fastening operation, e.g., the output torsion may be so small that the fastener cannot be fastened in place or the output torsion may be so great that the fastener is overloaded, thereby causing wear of the fastener or damages to the workpiece and affecting the service life of the tool.

SUMMARY

The following describes a torsion-adjustable impact wrench which is adapted for adjusting output torsion of an impact wrench with a higher precision.

The device according to the description that follows is a hand-held rotatable impact tool, including a housing and a powering unit including a motor and an impact mechanism driven by the motor wherein the impact mechanism is configured to generate an intermittently increasing torque. An adjusting unit is configured to set a first torsion value and to generate a corresponding first torsion signal. A detecting unit positioned on the motor detects a rotational speed of the powering unit and generates a corresponding first rotational speed signal. A control unit is configured to generate a control signal for controlling the output of the rotational speed of the powering unit wherein the control unit includes an electronic switch connected in series with the motor. The control unit generates a second rotational speed signal according to the first torsion signal outputted by the adjusting unit, compares the first rotational speed signal with the second rotational speed signal, and generates a control signal enabling the rotational speed of the powering unit to approach the second rotational speed. The control unit substitutes the first rotational speed signal and the second rotational speed signal into a PID increment algorithm and generating a PWM control signal according to its result. The electronic switch receives the PWM signal and thereby controls a duty ratio of electrical current flowing through the motor.

The detecting unit may include a speed sensor and a speed-measuring PCB board.

The hand-held rotatable impact tool may include a housing, a powering unit including an impact mechanism configured to generate an intermittently increasing torque, an adjusting unit configured to manually set a first torsion value and generate a corresponding a first torsion signal, a detecting unit capable of detecting a rotational speed of the powering unit and generating a corresponding first rotational speed signal, a control unit configured to generate a control signal for controlling the output of the rotational speed of the powering unit, the control unit being capable of generating a second rotational speed signal according to the first torsion signal outputted by the adjusting unit, comparing the first rotational speed signal with the second rotational speed signal, and generating a control signal enabling the rotational speed of the powering unit to approach the second rotational speed.

The powering unit may include a motor, and the detecting unit may be provided on the motor.

The detecting unit may include a speed sensor and a speed-measuring PCB board.

The control unit may include an electronic switch connected in series with the motor wherein the control signal generated by the control unit is a PWM signal, and the electronic switch is capable of receiving the PWM signal to thereby control a duty ratio of electrical current flowing through the motor.

The control unit may substitute the first rotational speed signal and the second rotational speed signal into a PID increment algorithm and generates a PWM control signal according to its result.

A method according to following description for adjusting and controlling torsion of the hand-held rotatable impact tool, includes the following steps:

presetting output torsion by the adjusting unit, the control unit reading a signal corresponding to the torsion value;

the control unit converting the preset torsion into a speed to be outputted according to a torsion-speed fitting formula stored therein, or inquires the speed which corresponds to the preset torsion and needs to be outputted according to a torsion-speed correspondence table calculated from the torsion-speed fitting formula;

the control unit generates a PWM signal according to the speed to be outputted, and transmits the signal to the electronic switch;

the detecting unit detects an actual rotational speed of the motor and transmits the corresponding signal to the control unit; and the control unit substitutes the rotational speed to be outputted and the actual rotational speed into PID increment algorithm, generates a PWM control signal according to its result, transmits it to the electronic switch to adjust a duty ratio of electrical current flowing through the motor and thereby enables the motor to output a rotational speed corresponding to the preset torsion.

The method may further include a step wherein the control unit compensates the output rotational speed according to a change of the temperature and voltage of the tool.

The modulated signal may be a PWM signal.

The speed control algorithm may be a PID increment algorithm.

The torsion-adjustable impact wrench thus enables the operator to perform precise selection of the output torsion of the impact wrench according to conditions of the fasteners and workpiece so that the output torsion matches specific fastening working conditions, not only effectively improving a working efficiency and operation accuracy but also assisting the operator in judging the conditions of the fastening and operating procedure, effectively avoiding conditions in which the fastener wears and the workpiece is damaged, and improving the service life of the tool.

BRIEF DESCRIPTION OF THE DRAWINGS

FIG. 1-A is a schematic view of a housing of an exemplary torsion adjustable impact wrench constructed according to the description that follows.

FIG. 1-B is a schematic view illustrating the structure of the torsion adjustable impact wrench of FIG. 1-A.

FIG. 2 is a schematic view of an exemplary powering unit of the torsion adjustable impact wrench of FIG. 1-A.

DETAILED DESCRIPTION

Figure 3:
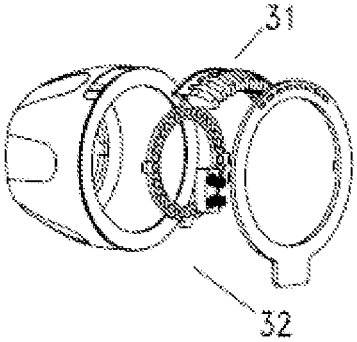
FIG. 3 is a schematic view of an exemplary adjusting unit of the torsion adjustable impact wrench of FIG. 1-A.

Referring to FIG. 1-A and FIG. 1-B, an exemplary torsion adjustable impact wrench includes a housing 1, a powering unit 2, an adjusting unit 3, a detecting unit 4 and a control unit 5. As shown in FIG. 2, the powering unit 2 includes a motor 21, a transmission means 22, an impact means 23 and an output means 24. Specifically, the transmission means 22 is a gear deceleration system, and preferably a planetary gear deceleration system. One end of the transmission means is connected to the motor for converting a first rotational speed output by the motor into a second rotational speed which is lower than the first rotational speed. The impact means 23 includes an intermediate shaft, a hammer and a hammer anvil. The hammer is sleeved on the intermediate shaft, wherein the intermediate shaft defines a first groove therein, and the hammer defines a second groove on an inside surface thereof, the hammer and the intermediate shaft are connected via balls that are accommodated between the first groove and the second groove so that the intermediate shaft can transmit a rotating action to the hammer and the hammer can move with respect to the intermediate shaft thereon. A hitting portion is provided at one end of the hammer, and a spring is connected to the other end of the hammer, wherein the spring provides a biasing force for the hammer in a direction from the hammer to the hammer anvil. An anvil portion cooperating with the hitting portion of the hammer is provided at one end of the hammer anvil, and the output means is connected at the other end of the hammer anvil.

The working principle of the torsion adjustable impact wrench is as follows: the intermediate shaft drives the hammer into rotation via the balls, and the hammer drives the hammer anvil into rotation via the cooperation of the hitting portion and the anvil portion; when the rotation of the hammer anvil is confronted with resistance, the resistance is transferred to the hammer via the cooperation of the anvil portion and the hitting portion; as the balls move along the grooves, the hammer resists against the biasing of the spring, crosses the engaged anvil portion and moves away from the hammer anvil a distance, and then rotationally returns back under the biasing of the spring to hit the anvil portion. While the hammer anvil is confronted with the resistance, the hammer makes a reciprocating axial rotational movement on the intermediate shaft so as to produce an intermittently increasing torque. The output means 24 includes a clamping portion disposed at an end of the hammer anvil, and a clamping accessory detachably connected to the clamping portion. The clamping portion and the clamping accessory may hold a matching fastener such as a bolt, nut, screw or the like, respectively.

As shown in FIG. 3, the adjusting unit 3 includes a display assembly 31 and a setting assembly 32. The display assembly 31 may employ an LED lamp display which receives an electrical signal transmitted by the setting assembly and displays a corresponding torque level. The display assembly may also employ an LCD digital display that displays a torque value set by the setting assembly. The setting assembly 32 may employ a torsion cup, and a torsion level is set by rotating the torsion cup to produce a corresponding electrical signal and then transmit it to the display assembly. The setting assembly 32 may also employ an LCD digital setting device in which a specific torque is set via a button, and a corresponding electrical signal is transmitted to the display assembly.

Figure 4:
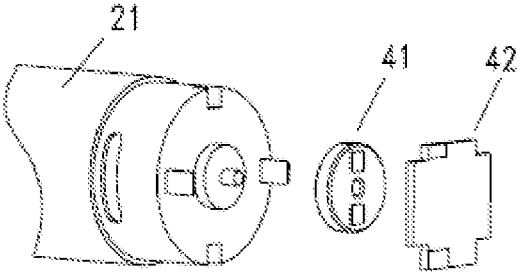
FIG. 4 is a schematic view of an exemplary detecting unit of the torsion adjustable impact wrench of FIG. 1-A.
Figure 5:
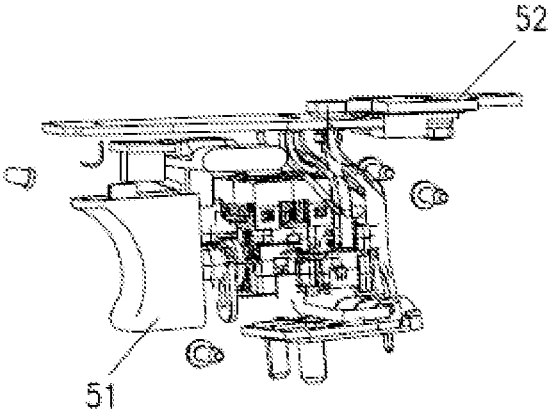
FIG. 5 is a schematic view of an exemplary control unit of the torsion adjustable impact wrench of FIG. 1-A.

As shown in FIG. 4, the detecting unit 4 is disposed at a rear end of the motor 21 and includes a speed sensor 41 and a speed-measuring PCB board 42. The speed sensor 41 senses a rotational speed of a pivotal shaft of the motor and converts it into another physical signal such as an electrical signal, a magnetic signal or an optical signal. The speed-measuring PCB board 42 processes the signal so as to obtain a corresponding rotational speed signal. Furthermore, the speed-measuring PCB board 42 transmits the actual rotational speed signal to a main PCB board in real time. As shown in FIG. 5, the control unit 5 includes a trigger switch 51 and a main PCB board 52. The trigger switch 51 is connected with the main PCB board 52. An operator may start the impact wrench to operate by pressing the trigger switch 51. The main PCB board 52 is connected with the adjusting unit 3 and the detecting unit 4, and controls the whole torsion adjusting procedure.

Figure 6:
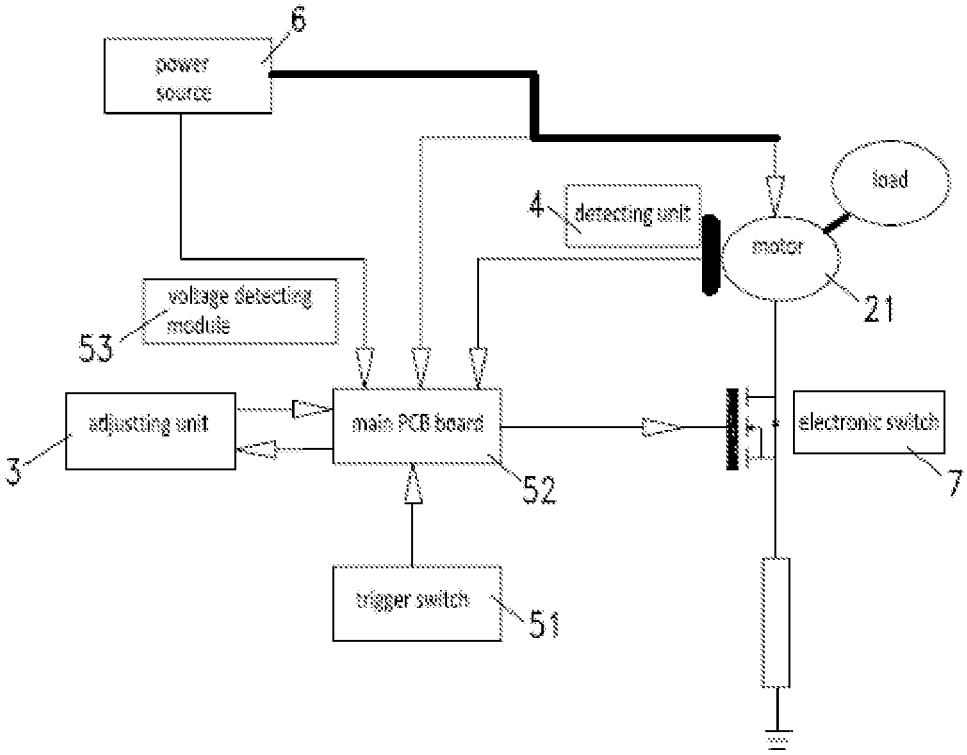
FIG. 6 is a diagram illustrating connection relationship of a torsion adjustment control system of the torsion adjustable impact wrench of FIG. 1-A.

As shown in FIG. 6, detailed description will be presented for a torsion adjusting and controlling system of the torsion adjustable impact wrench. The torsion adjusting and controlling system includes a power source 6, the motor 21, an electronic switch 7, the detecting unit 4, the adjusting unit 3, the main PCB board 52 and the trigger switch 51. The power source 6 is a DC power source provided by a battery pack detachably connected to the impact wrench, which provides voltage to the motor 21 and the main PCB board 52. The power source 6 directly performs voltage load for the motor 21, and performs voltage load for the main PCB board 52 via a LDO linear negative booster or DC-DC negative booster. An end of the motor 21 is connected to the power source 6, and the other end thereof is grounded via the electronic switch 7. The electronic switch 7 may be one selected from elements such as a MOSFET, a relay and a thyristor. The present embodiment preferably employs a MOSFET.

The detecting unit 4 is disposed on the motor and outputs a signal for the main PCB board 52. The detecting unit 4 includes the speed sensor 41 and the speed-measuring PCB board 42. The speed sensor 41 may be one selected from an inductive sensor, a Hall sensor and a photoelectric sensor. The present embodiment preferably employs a photoelectrical sensor.

The speed-measuring PCB board 42 performs detection through comparison, counting and time keeping, and converts the signal sensed by the speed sensor 41 into an actual rotational speed signal and transmits it to the main PCB board 52. A signal may be mutually transferred between the adjusting unit 3 and the main PCB board 52. On the one hand, the adjusting unit 3 may transmit to the main PCB board 52 a pre-set torsion level or torsion value set by the operator, and on the other hand, it may receive the signal transmitted by the main PCB board 52 to display an actual working torsion value of the impact wrench. The main PCB board 52 is connected to the power source 6, the electronic switch 7, the detecting unit 4, the adjusting unit 3 and the trigger switch 51 respectively, and controls the whole torsion adjusting procedure. Specifically, the main PCB board 52 controls a power supply circuit of the motor 21 via the electronic switch 7, may perform PWM control for the electronic switch 7, adjust a duty ratio of electrical current flowing through the motor 21 and thereby adjust the rotational speed of the motor 21. The main PCB board 52 receives a torsion signal transmitted by the adjusting unit 3, obtains a corresponding output rotational speed signal through processing and conversion, outputs a corresponding PWM signal for the electronic switch 7 and enables the motor 21 to perform the corresponding output. The main PCB board 52 receives the actual rotational speed signal sent by the detecting unit 4, compares the actual rotational speed signal with the output rotational speed signal, obtains a corresponding control signal through processing and conversion, adjusts the PMW signal according to the control signal so as to enable the actual rotational speed of the motor 21 to approach the output rotational speed corresponding to the set torsion. The main PCB board 52 further includes a voltage detecting module 53 which detects the voltage of the power source 6 and transmits the signal to the main PCB board 52, and the main PCB board 52 compares the signal with a stored preset threshold value so as to perform low-voltage protection for the power source 6. When the voltage of the power source falls below the threshold value, a warning is sent and the power supply circuit is cut off.

A control unit of the main PCB board 52 according to the present embodiment preferably employs an 8-bit or 16-bit single-chip microcomputer, wherein 10 pins thereof are used for judgment of the trigger switch 51, the driving of display of the adjusting unit 4, judgment of the rotational speed detection signal of the detecting unit 4, and the PWM control of the electronic switch 7 respectively. The trigger switch 51 may input the signal for the main PCB board 52 by means a mechanical pressing act to enable the main PCB board 52 to energize the power supply circuit of the motor 21, thereby starting the machine.

Figure 7:
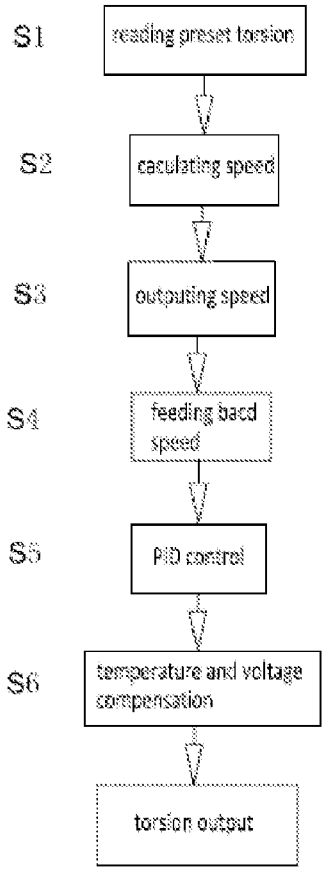
FIG. 7 is a flow chart of an exemplary method of torsion adjustment and control of the torsion adjustable impact wrench of FIG. 1-A.

Referring to FIG. 7, specific steps of the torsion adjusting and controlling procedure are described as follows:

Step S1 is reading a preset torsion. The operator sets a pre-output torsion value through the adjusting unit 3, and the main PCB board 52 reads an electrical signal corresponding to the torsion value;

Step S2 is calculating a speed. The main PCB board 52 converts the preset torsion value into a speed value to be outputted according to a torsion-speed fitting formula, or inquires the speed value which corresponds to the preset torsion value and needs to be outputted according to a torsion-speed correspondence table calculated from the torsion-speed fitting formula;

Step S3 is outputting the speed. The main PCB board 52 obtains a PWM signal according to the speed to be outputted, transmits the signal to the MOSFET electronic switch 7, adjusts a duty ratio of electrical current flowing through the motor 21 and thereby enables the motor 21 to output a rotational speed corresponding to the preset torsion value;

Step S4 is feeding back a speed. The rotational speed of the motor 21 is detected in real time via the speed sensor 41 and the speed-measuring PCB board 42, and the corresponding signal is transmitted to the main PCB board 52. A reason for feeding back the speed is that due to influence of factors such as a load, power source voltage and a working temperature, an actual output speed of the motor 21 is not consistent with the speed to be outputted;

Step S5 is PID control. The main PCB board 52 performs PID control according to the rotational speed value to be outputted and the current actual rotational speed value. The specific procedure of PID control is described hereunder in detail; and Step S6 is temperature and voltage compensation. Since the temperature of the transmission system rises, the output torsion is affected, the output speed may be adjusted according to a preset temperature-torsion change curve, and an error caused by the temperature change is compensated; as the power source voltage falls, a warning is given and the power supply circuit is cut off when the output does not reach the predetermined torsion output.

The tool system may stably output the preset torsion according to the above six steps.

Figure 8:
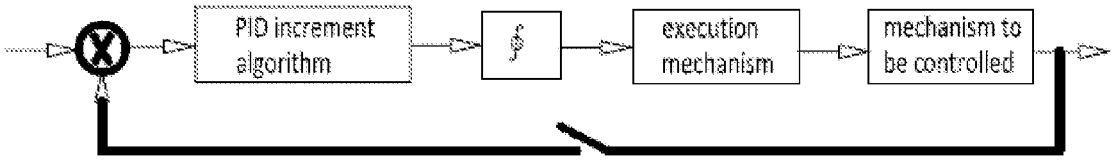
FIG. 8 is schematic view illustrating an exemplary PID control procedure of the torsion adjustable impact wrench of FIG. 1-A.

Referring to FIG. 8, the specific procedure of the PID control is described in detail. The main PCB board 52 collects the actually-outputted speed through the detecting unit 4 by using a constant sampling period T, substitutes the rotational speed value to be outputted and the actually-collected rotational speed value into PID increment algorithm which is a calculating method well-known in the art and will not be described here in detail any more. A deviation value of the rotational speed is calculated. Then a proportion, integral and differential of the deviation value constitute a parameter through linear combination, the control parameter is incrementally integrated, finally the main PCB board 52 obtains a PWM control signal according to the integration result, and transmits the PWM signal to an execution mechanism which controls a mechanism to be controlled, wherein the execution mechanism is the MOSFET electronic switch 7, the mechanism to be controlled is the motor 21, and the MOSFET electronic switch 7 adjusts the duty ratio of electrical current flowing through the motor 21 according to the received PWM signal, thereby realizing the PID control of the output rotational speed.

The specific embodiments described above are only description of ideas and principles of the present invention and not intended to limit the content of the present invention. Those having ordinary skill in the art may appreciate that besides the above preferred specific embodiments, the present invention further has many other alternative or amended embodiments, which still fall within the scope of the present invention. The scope of the present invention is defined by the appended claims.

What is claimed is:

1. A hand-held rotatable impact tool, comprising a housing;

a powering unit comprising a motor and an impact mechanism driven by the motor, and the impact mechanism being configured to generate an intermittently increasing torque;

an adjusting unit configured to set a first torsion value and generate a corresponding first torsion signal;

a detecting unit positioned on the motor, the detecting unit being capable of detecting a rotational speed of the powering unit and generating a corresponding first rotational speed signal;

a control unit configured to generate a control signal for controlling the output of the rotational speed of the powering unit, the control unit comprising an electronic switch connected in series with the motor, the control unit generating a second rotational speed signal according to the first torsion signal outputted by the adjusting unit, comparing the first rotational speed signal with the second rotational speed signal, generating a control signal enabling the rotational speed of the powering unit to approach a speed corresponding to the second rotational speed signal while the powering unit outputs a torque approaching a torque corresponding to the first torsion value set by the adjusting unit, substituting the first rotational speed signal and the second rotational speed signal into a PID increment algorithm and generating a PWM control signal according to its result, wherein the electronic switch receives the PWM signal and thereby controls a duty ratio of electrical current flowing through the motor, to maintain a constant speed and torque;

the control unit further comprising a trigger switch operable coupled to the motor, wherein the motor starts to operate when the trigger switch is pressed and stops when the trigger switch is released.

2. The hand-held rotatable impact tool according to claim 1, wherein the detecting unit comprises a speed sensor and a speed-measuring PCB board.

3. A hand-held rotatable impact tool, comprising a housing;

a powering unit comprising an impact mechanism configured to generate an intermittently increasing torque;

an adjusting unit configured to set a first torsion value and generate a corresponding first torsion signal;

a detecting unit capable of detecting a rotational speed of the powering unit and generating a corresponding first rotational speed signal; and a control unit configured to generate a control signal for controlling the output of the rotational speed of the powering unit wherein the control unit generates a second rotational speed signal according to the first torsion signal outputted by the adjusting unit, compares the first rotational speed signal with the second rotational speed signal, and generates a control signal enabling the rotational speed of the powering unit to approach a speed corresponding to the second rotational speed signal while the powering unit outputs a torque approaching a torque corresponding to the first torsion value set by the adjusting unit, to maintain a constant speed and torque, the control unit further comprising a trigger switch operably coupled to the powering unit, wherein the impact tool starts to operate when the trigger switch is pressed and stops when the rigger switch is released.

4. The hand-held rotatable impact tool according to claim 3, wherein the powering unit further comprises a motor and the detecting unit is provided on the motor.

5. The hand-held rotatable impact tool according to claim 4, wherein the detecting unit comprises a speed sensor and a speed-measuring PCB board.

6. The hand-held rotatable impact tool according to claim 4, wherein the control unit comprises an electronic switch connected in series with the motor, the control signal generated by the control unit is a PWM signal, the electronic switch is capable of receiving the PWM signal to thereby control a duty ratio of electrical current flowing through the motor.

7. The hand-held rotatable impact tool according to claim 3, wherein the control unit substitutes the first rotational speed signal and the second rotational speed signal into a PID increment algorithm and generates a PWM control signal according to its result.

8. A method for adjusting and controlling torsion of a hand-held rotatable impact tool, comprising:

pressing a trigger switch to start operation of the impact tool;

causing a control unit to read a signal corresponding to a value of an output torsion preset by use of an adjusting unit;

causing the control unit to convert the output torsion preset into a rotational speed to be output using a torsion-speed fitting formula;

causing the control unit to generate a first modulated signal according to the rotational speed to be output, and transmitting the first modulated signal to an electronic switch connected to a powering unit to enable the powering unit to produce an output;

causing a detecting unit to detect an actual rotational speed of the powering unit and to transmit a signal indicative of the detected actual rotational speed to the control unit;

causing the control unit to substitute the rotational speed to be output and the actual rotational speed into a speed control algorithm, to generate a second modulated signal according to a result obtained from the speed control algorithm, and to transmit the second modulated signal to the electronic switch to thereby control the powering unit to output a rotational speed approaching the rotational speed to be output and output a torque corresponding to the output torsion preset, to maintain a constant speed and torque;

releasing the trigger switch when a task is finished to stop the impact tool.

9. The method for adjusting and controlling torsion according to claim 8, wherein the method further comprises causing the control unit to compensate the rotational speed to be output according to changes of temperature and voltage of the tool.

10. The method for adjusting and controlling torsion according to claim 8, wherein the second modulated signal is a PWM signal.

11. The method for adjusting and controlling torsion according to claim 8, wherein the speed control algorithm is a PID increment algorithm.

* * * * *